US006508530B1

(12) United States Patent
Conta et al.

(10) Patent No.: US 6,508,530 B1
(45) Date of Patent: Jan. 21, 2003

(54) ALIGNING METHOD FOR MULTIPLE INK JET COLOR PRINTHEADS WITH BUILT-IN OPTOELECTRONIC POSITION DETECTOR

(75) Inventors: Renato Conta, Ivrea (IT); PierLuigi Soriani, Virgilio (IT)

(73) Assignee: Olivetti Tecnost S.p.A., Ivrea (IT)

( * ) Notice: Subject to any disclaimer, the term of this patent is extended or adjusted under 35 U.S.C. 154(b) by 0 days.

(21) Appl. No.: 09/937,597

(22) PCT Filed: Mar. 17, 2000

(86) PCT No.: PCT/IT00/00087

§ 371 (c)(1),
(2), (4) Date: Sep. 28, 2001

(87) PCT Pub. No.: WO00/58101

PCT Pub. Date: Oct. 5, 2000

(30) Foreign Application Priority Data

Mar. 29, 1999 (IT) ..... TO99A0241

(51) Int. Cl.[7] ..... B41J 29/393; B41J 29/138
(52) U.S. Cl. ..... 347/19; 347/14
(58) Field of Search ..... 347/19, 9, 37, 347/14, 23, 12, 10, 11; 400/279; 318/434

(56) References Cited

U.S. PATENT DOCUMENTS

| | | | |
|---|---|---|---|
| 5,717,451 | A | 2/1998 | Katano et al. |
| 5,751,305 | A | 5/1998 | Hadley |

FOREIGN PATENT DOCUMENTS

| | | |
|---|---|---|
| EP | 0 775587 | 5/1997 |
| IT | TO 97 0844 | 3/1999 |
| JP | 09-226174 | 9/1997 |
| WO | 99/15338 | 4/1999 |

*Primary Examiner*—John Barlow
*Assistant Examiner*—Charles W. Stewart, Jr.
(74) *Attorney, Agent, or Firm*—Banner & Witcoff, Ltd.

(57) ABSTRACT

The single heads (40) mounted on a single print carriage of an ink jet printer comprise a column (50) of phototransistors **(51-*i*), built directly into the chip of each head in the same process steps as used for the circuits for selecting and driving the actuating resistors; an illuminating device (43) on board the printer focuses a light spot (70) on the column (50) of phototransistors (51-*i*) which, scanned in sequence, provide the electronic controller of the printer a video output (57); from the output (57), processing and computing means produce a measurement of the vertical and horizontal misalignment of each head (40)**, a measurement used subsequently to automatically compensate this misalignment.

20 Claims, 9 Drawing Sheets

51-i
50
70
V-i
V-max
V-6
V-7
V-8
t-1
t-2
t-6
t-7
t-8
T
t

V-5
V-9
t-5
t-9

ALIGNING METHOD FOR MULTIPLE INK JET COLOR PRINTHEADS WITH BUILT-IN OPTOELECTRONIC POSITION DETECTOR

This is a U.S. National Phase Application Under 35 USC 371 and applicant herewith claims the benefit of priority of PCT/IT00/00087 filed Mar. 17, 2000, which was published Under PCT Article 21(2) in English and Application No. TO99A000241 filed in Italy on Mar. 29, 1999.

TECHNICAL FIELD

The system according to the invention is designed to obtain the operating alignment between two or more printheads containing different coloured inks, mounted on the scanning carnage of an ink jet dot matrix printer.

BACKGROUND ART

Ink jet colour printers are widely known, both thermal type and piezoelectric type, provided with a multiplicity of monochromatic heads (typically three or four) containing different coloured inks (typically corresponding to the fundamental colours cyan, yellow and magenta, with sometimes black); each head possesses a large number of nozzles for the ejection of the droplets of ink (for example three hundred, but the current technological trend is leading to even greater numbers) arranged at a constant pitch in one or more parallel rows, with a like number of ejecting elements for generating the droplets of ink selectively ejected through the nozzles corresponding to each one.

As is known in the most recent art, the thermal type ink jet printheads comprise a substrate or "chip" of semiconductor material (generally Silicon) on which the ejection resistors and the power drivers with which to drive them and also the logic for selection of the single ejection resistor to be driven are made, using known technologies; for the first-named, thin film technology is normally used, for the second, LDMOS technology ("lateral double diffused MOS") and for the third, CMOS technology.

The precision of relative positioning of the nozzles among each other on a single head is very high, since the nozzle carrier plate is made all of a piece and the active part of the head is produced on a single silicon chip, using microlithic-photographic techniques guaranteeing considerable mechanical precision. Not so high is the positioning precision with which the chip is assembled on the body of the container of the head. The head, in turn, is mounted on the scanning carriage of the printer, so that the final alignment of the nozzles among the various monochromatic heads (needed to produce good quality printing, especially in high definition, as is known to those acquainted with the sector art) can only be obtained by means of additional operative head aligning operations to be effected, more or less automatically, directly on the printer, with resultant difficulties of a practical and economic nature.

Various methods have been proposed for automating the alignment of the different monochromatic heads, such as for example those described in U.S. Pat. Nos. 5,644,344, 5,600,350, 5,451,990, 5,448,269, 5,404,020, 5,289,208, 5,250,956 and EP 0 674 993. In all these cases, a specimen plot is printed on a sheet and the positional errors of the sheet are subsequently detected.

Another class of solutions, such as for example those described in U.S. Pat. Nos. 5,499,098, 5,350,929, 5,276,467 and EP 0 734 877, comprises the use of masks or grids through which the misalignments between the heads are detected by means of optical devices.

The U.S. Pat. No. 4,709,248 presents a device consisting of an illuminating device, an optical detector capable of picking up a known characteristic of the heads and a linear encoder by means of which to measure precisely the position of the print carriage along the direction of its travel. The misalignments between the heads are obtained from the measurement of the carriage's position whereas the optical system picks up transit of the known characteristic of each single head.

In the Italian patent No. IT 1 294 891, corresponding to the International patent application No. PCT/IT98/00251, an aligning method for multiple ink jet colour printheads is presented, together with a relative printhead and built-in optical position detector, though practical production difficulties exist due to the non-linearity of the electro-optical position sensors.

DISCLOSURE OF THE INVENTION

The object of this invention is that of defining a system for obtaining the operative alignment, both horizontal (scanning direction) and vertical (line feed direction), of the printheads of an ink jet colour printer provided with multiple monochromatic heads, with the precision and linearity necessary for high quality colour printing at high definition The system of the invention is based on the availability of printheads comprising at least one optoelectronic device which acts as an optical position sensor, made of a column of phototransistors, built into the same chip as the head, i.e. made in the course of the same production process, with the same process steps and the same masks as are needed in any case to produce an integrated thermal ink jet head, and therefore without any increase of the costs and difficulty with respect to the known heads.

In this way, the integrated optoelectronic device acts as an optical position sensor aligned with the nozzles with photolithographic precision, with which it is possible to detect automatically, via the procedure described below, both the horizontal and the vertical position of each single monochromatic head mounted on the scanning carriage; the system of the invention uses the position readings thus made to effect, through the printer's electronic controller, the appropriate corrections with which to compensate the geometric alignment errors encountered.

The horizontal alignment errors are corrected by appropriately delaying or advancing the ejection of the droplets of ink by the various monochromatic printheads in relation to the difference between the theoretical position and the real position of the head itself; the vertical alignment errors, on the other hand, are corrected by suitably staggering electronic driving of the nozzles by one or more positions, accepting a maximum misalignment equal to one half of the pitch between the nozzles and not using the nozzles of each head located outside a common alignment band.

Another object of this invention is that of defining a rapid and precise method for aligning the nozzle carrier plate with respect to the silicon substrate during the head manufacturing process, avoiding critical factors due to variations of the optical contrast between different batches of film found in other methods, using viewing systems for the alignment.

A further object of the invention is that of defining a rapid and precise method for aligning the subassembly consisting of the nozzle carrier plate and the silicon substrate, on the plastic body of the head.

The above-mentioned objects are obtained by means of an aligning method for multiple ink jet colour printheads with built-in optoelectronic position detector, characterized as defined in the main claims.

These and other objects, characteristics and advantages of the invention will be apparent from the description that follows of a preferred embodiment, provided purely by way of an illustrative, non-restrictive example, and with reference to the accompanying drawings.

BEST MODE FOR CARRYING OUT THE INVENTION

Figure 1:
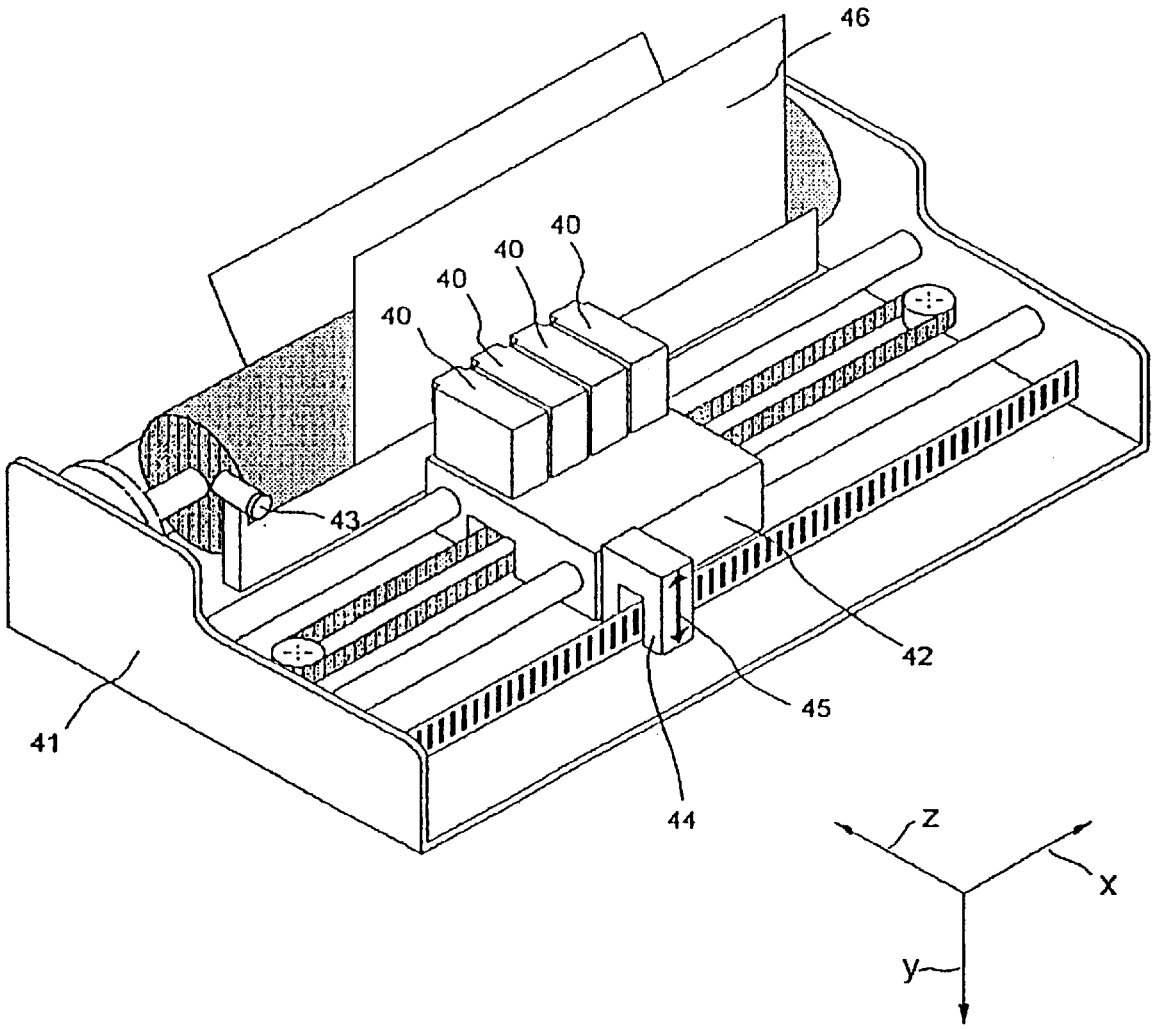
FIG. 1—Represents the axonometric projection of an inkjet printer.

FIG. 1 depicts an ink jet colour printer, indicating the relevant parts for the purposes of this invention. Visible in the figure are a fixed structure 41, a scanning carriage 42, four monochromatic printheads 40, a fixed illuminating device 43, an encoder 44 and a gauge block 45.

The printer may constitute a self-standing product, or be part of a photocopier, of a plotter, of a facsimile machine, of a machine for the reproduction of photographs and the like. Printing is effected on a physical medium 46, generally consisting of a sheet of paper, or a sheet of plastic, fabric or the like.

Also shown in FIG. 1 are the axes of reference:

x axis: horizontal, i.e. parallel to the scanning direction of the carriage 42;

y axis: vertical, i.e. parallel to the line feed direction;

z axis: perpendicular to the x and y axes.

The aligning system according to the invention, designed to obtain the operative alignment, both horizontal and vertical, of the monochromatic heads 40 mounted on the scanning caniage 42 with the precision necessary for high definition colour printing, requires the availability, in addition to what is normally found in a similar printer according to the known art, of:

a) printheads provided with a built-in phototransistor column, i.e. made in the course of the same production process, with the same process steps as necessary to produce semiconductor integrated circuits, with which the other components needed for operation of the head itself such as the ejection resistors, the selection and driving circuits, and the conductors for connection, are made in the common silicon substrate, b) a fixed illuminating device 43 on board the printer, c) an electronic controller capable of processing in a first mode the signals generated by the phototransistor column and of staggering by one or more positions, both ways in the vertical direction, the commands to the ink ejection nozzles, d) an electronic controller capable of processing in a second mode the signals generated by the phototransistor column and of delaying or advancing the ejection of the droplets of ink in relation to the signals thus processed, with the purpose of correcting the alignment errors in the horizontal direction.

Printhead provided with a built-in phototransistor column—The printhead 40 according to the invention is a multi-nozzle, thermal type ink jet head, with selecting and driving circuits produced in CMOS and LDMOS technology and components for generating the droplets produced in thin film technology, integrated on a single support (semiconductor substrate or chip), of a type known in the sector art.

Figure 2:
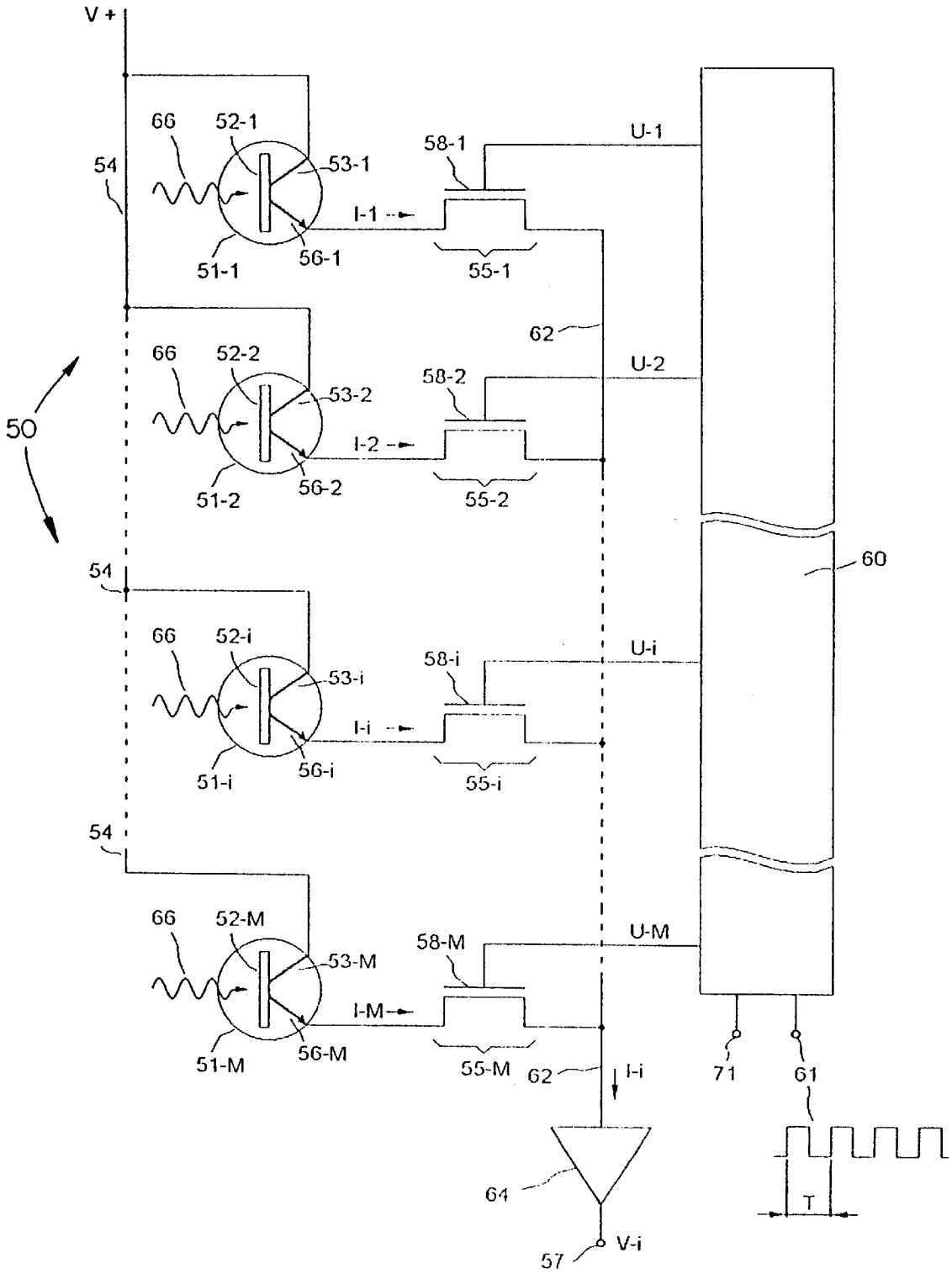
FIG. 2—Represents the schematic circuit diagram of a column of phototransistors constituting an optoelectronic device.

The semiconductor substrate also comprises a column 50 of phototransistors, the wiring diagram of which is shown in FIG. 2, built into the same support and made in the same process steps as needed to produce the semiconductor integrated circuits mentioned above. The phototransistors of the column 50 are placed vertically, i.e. in the direction of the y axis, parallel to the lines of nozzles and are addressed by a shift register 60, made in CMOS technology during the same process steps as needed to produce the other components of the head.

From the electrical viewpoint, the column 50 consists of M phototransistors 51-*i,* where i is variable from 1 to M, having open bases 52-*i;* common collectors 53-*i* electrically connected together at a common node 54 from which they receive a power supply voltage V+; and independent emitters 56-*i*. By way of example, M could have the value 16.

The phototransistors 51-*i,* through the emitters 56-*i,* raise photocurrents I-i, substantially proportional to the illuminated area and to the intensity of the light affecting each of the bases 52-*i,* when the latter are suitably illuminated by a light beam 66.

The head also comprises a shift register 60, which presents M voltages U-i on a like number of output positions; a plurality of MOSFET transistors 55-*i,* which perform a function of electronic switch on the currents I-i, enabled to conduct one at a time and in succession by way of a suitable sequence of the voltages U-i applied to the gate electrodes 58-*i;* a common bus 62 that collects the current I-i selected in each case; and a charge amplifier 64, which receives as input the current I-i conducted by the common bus 62, and which provides on the output 57 a voltage V-i substantially proportional to the current I-i.

Generation of the analog signals of the voltage V-i output by the charge amplifier 64, through the combined action of the components specified, will be described in detail below.

Figure 3:
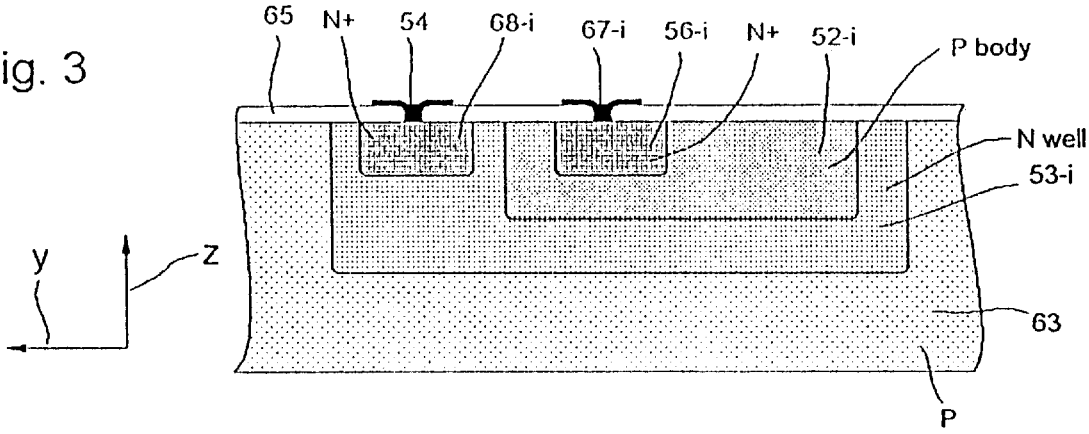
FIG. 3—Represents the physical structure of a phototransistor of the column of FIG. 2.

The physical structure of the column 50 of phototransistors is represented schematically in FIG. 3 through a view according to a section parallel to the y-z plane, which shows only one of the phototansistors 51-*i,* consisting of a N "well" zone made by diffsion on a P type silicon substrate 63, constituting the collector 53-*i* connected to the common node 54 through an N+ type contact 68-*i;* of a P type "body"

constituting the open base 52-*i;* and of the N+ type layer, constituting the emitter 56-*i*. The column 50 of phototransistors is then protected by a protective passivating layer 65, with the exception of the areas on which the metallizations are deposited that constitute the contacts with the output conductors 54 for the collectors, and 67-*i* for the emitters.

Figure 4:
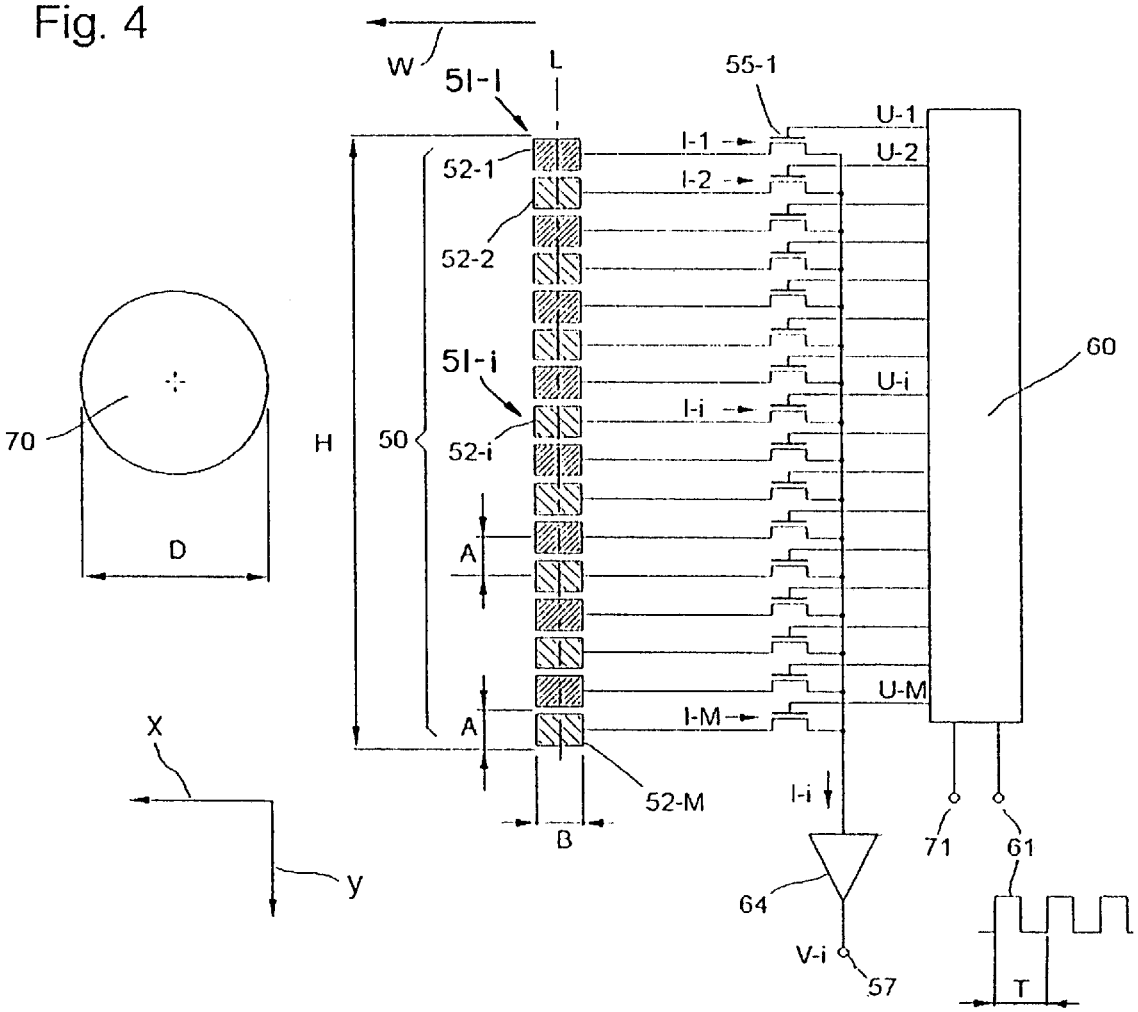
FIG. 4—Indicates the geometrical dimensions of the phototransistor column and of the light spot.

The geometrical configuration of the light-sensitive areas, corresponding to the open bases 52-*i* of the phototransistors 51-*i* constituting the column 50, is represented in FIG. 4. Each of the light-sensitive areas 52-*i* has, as a purely illustrative, non-restricting example, a square shape of side preferably between 10 and 50 μm, or a rectangular shape the dimensions A and B of which are preferably within the following limits:

| | | |
|---|---|---|
| A | Height, parallel to the y axis | 10 ÷ 50 μm |
| B | Width, parallel to the x axis | 10 ÷ 150 μm |

In addition, these light-sensitive areas 52-*i* are contiguous and in column formation so as to form as a whole the column 50 of phototransistors, having the shape of a single rectangle of height H, parallel to the y axis.

The process described enables optimal reproducibility to be obtained of the photoelectric characteristics of the phototransistors 51-*i,* as these depend essentially on the doping of the P "body" 52-*i* and on the P "body"—N "well" junction, so that the dispersion of the emitter photocurrent values of the various phototransistors built into the same "chip" is less than ±2%, whereas the dispersion of the emitter photocurrent between columns of phototransistors 50 on different chips is in the order of ±10%, where doping of the N and P areas is achieved through ion implantation, with doping control better than ±5%.

But the principal advantage obtained from integrating the column 50 in the chip of the head is the extreme precision with which the column 50 itself is positioned with respect to the nozzles, as it is produced in the same silicon substrate that contains the other components, using microlithic-photographic techniques guaranteeing great mechanical precision.

Figure 4A:
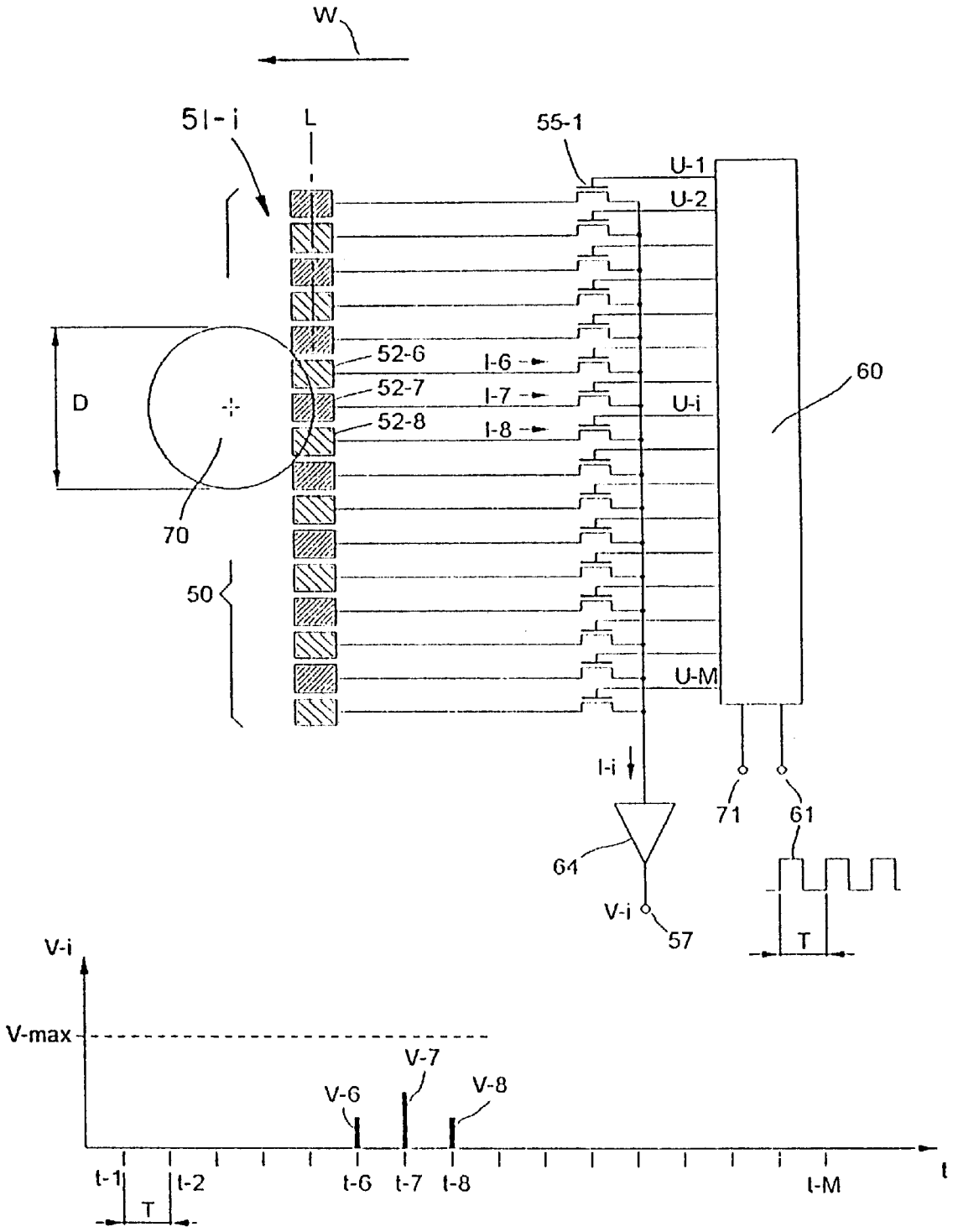
FIGS. 4*a* and 4*b*—Represent a video output produced by two different scannings of the signals generated by the phototransistor column when it passes through the light spot.
Figure 4B:
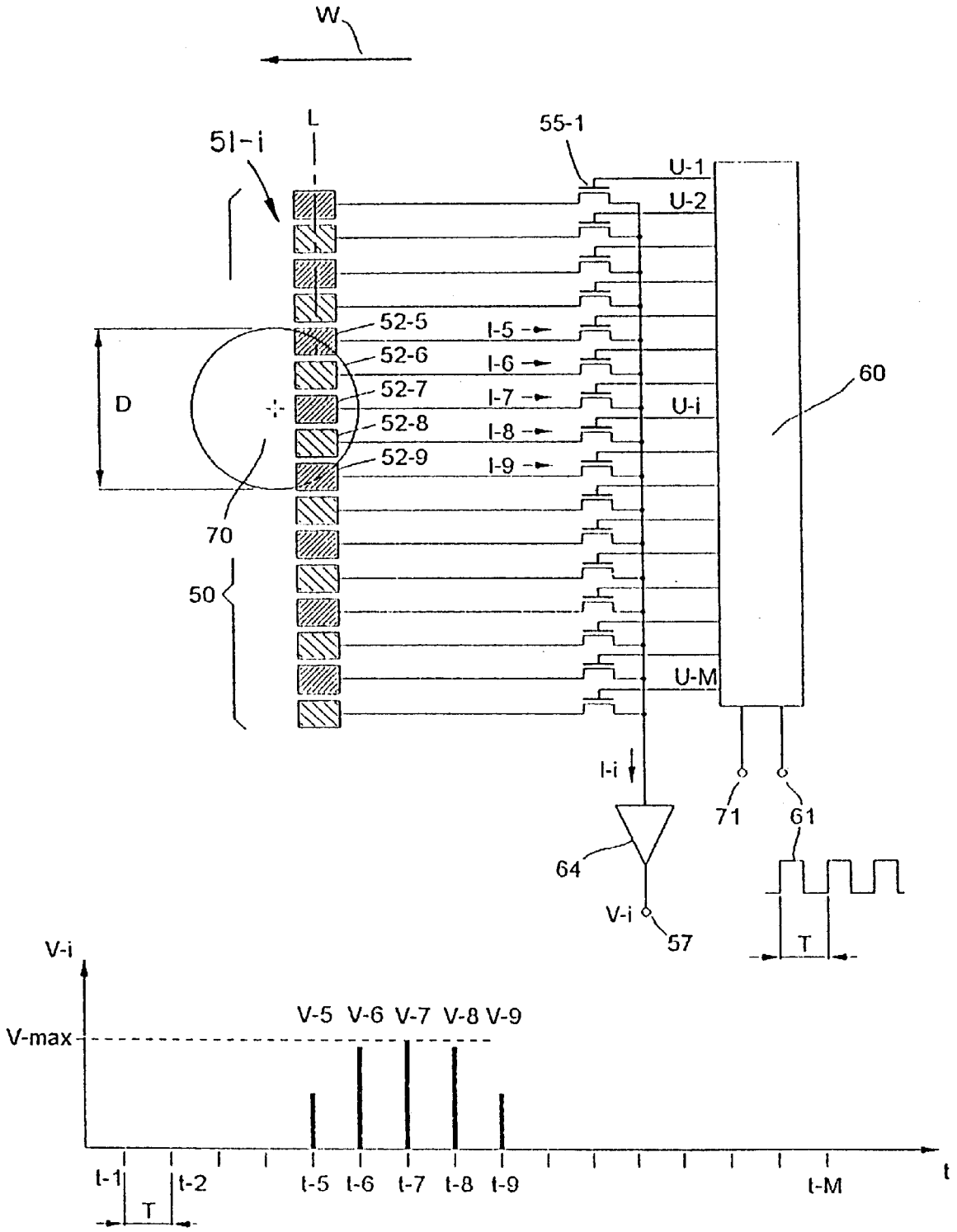

Illuminating device—The illuminating device 43 consists of a light source, typically a light-emitting diode (LED) or laser diode, known in themselves, and is mounted on an element fixed with respect to the structure 41 of the printer. Using a known optical system, the devices focuses (or points) the light beam 66 in such a way as to form a round "spot" 70 of light on the plane of the light-sensitive areas 52-*i* of the column 50, parallel to the x-y plane, as is depicted in FIGS. 4, 4*a* and 4*b*.

Electronic controller—Typically comprises a microprocessor, known in itself and completely standard electronic circuits, of known type.

Generation of signals—The method with which the column 50 of phototransistors is used for generating the signals needed for alignment of a head according to this invention will now be described, with reference to FIG. 2. Each phototransistor 51-*i,* through the emitters 56-*i,* raises a photocurrent I-i, substantially proportional to the illuminated area and to the intensity of the light affecting the corresponding base 52-*i,* when the latter is duly illuminated by the light beam 66.

Initially the reset signal 71 of the shift register 60 is activated, and after a certain length of time it is de-activated. During the first clock period 61 following de-activation of the reset 71, the shift register 60 switches the output U-1 only to logic value "1", while it leaves all the remaining outputs, from U-2 to U-M, at logic value "0". This results in conduction of the MOSFET 55-1 only, which causes the current I-1 to transit on the common bus 62. This enters the charge amplifier 64, which provides on the video output 57 a voltage V-1, substantially proportional to I-1, which is accordingly available for subsequent processing purposes.

As an alternative to the charge amplifier 64, a converter may be used supplying a pulse train, a binary code or other similar signal on the output 57, without departing in any way from the scope of this invention.

On expiry of one period of the clock 61, of duration T, the shift register 60 switches the output U-1 to logic value "0", switches the output U-2 only to logic value "1", and leaves all the remaining outputs, from U-3 to U-M, at logic value "0". This results in conduction of the MOSFET 55-2, which causes the current I-2 to transit on the common bus 62. The charge amplifier 64 supplies a voltage V-2, substantially proportional to I-2, on the output 57.

Similarly, in the subsequent clock periods 61, the shift register 60 switches the outputs U-i to logic value "1" in succession and one at a time, causing the currents I-i to transit on the common bus 62, one at a time and in succession. Consequently the charge amplifier 64 on the output 57 supplies the voltages V-i, one at a time and in succession, substantially proportional to I-i.

After activating the output U-M, and supplying the voltage V-M to the output 57, the cycle starts up again as above, with activation of the output U-1.

The description continues with reference to FIG. 4. In addition to the dimensions A, B, H, the duration T of one clock period and the number M, already defined, the following quantities are further defined:

D Diameter of the light spot

K Number of scannings performed during lighting of the column 50

Duration of the passing through

S Duration of scanning

W Speed of the carriage during the measurement and the following, non-restrictive assumptions are made:

- the vertical misalignment of the head with respect to the theoretical position is maintained within ±150 μm;
- each of the light-sensitive areas 52-*i* has a square shape of dimensions A×B=20×20 μm;
- the number M of phototransistors is 16, and therefore the overall height of the column 50 of phototransistors is H=M×A=16×20 μm=320 μm;
- the frequency of the clock 61 of the shift register 60 is 0.5 MHz, and accordingly the duration of the period is T=2 μs, and therefore the overall duration S of a scanning is S=M×T=16×2 μs=32 μs; and
- the diameter D of the spot 70 is D=100 μm.

During the misalignment measuring operation, the carriage 42 which has on board the head 40 with the column 50 of phototransistors is moved at a low speed W, for example 1 cm/s parallel to the x axis, in such a way that the column 50 of phototansistors passes through the spot 70 in the direction indicated the vector W.

The time Q that elapses between a first moment at which the column 50 of phototransistors is initially grazed by the spot 70 and a second point at which the column 50 of phototransistors completely abandons the spot 70 is sufficient for the shift register 60 to command numerous complete scannings of the currents I-i. In actual fact, with the values of the example, during the time Q the column 50 has to travel a distance equal to (20 μm+100 μm)=120 μm which, at the assumed speed W of 1 cm/s, requires Q=12 ms, whereas the complete scanning of the 16 signals V-i has a duration S of 32 μs. Between said first and said second points, it is therefore possible to effect a number K of scannings given by $$K=Q/S=375.$$

FIG. 4*a* represents the column 50 while it is entering under the spot 70. In this first configuration, the spot 70 partially illuminates the light-sensitive area 52-7 and to a lesser extent the areas 52-6 and 52-8.

Plotted on the time axis t of the Cartesian diagram of FIG. 4*a* are the moments t-i corresponding to the successive activations of the outputs U-1 during a scanning, separated from each other by the interval T, equal to the clock period 61. Plotted on the ordinates axis are the signals V-i present on the video output 57 at the moments t-i. On this diagram, which corresponds to a scanning effected during this first configuration, only the signals V-6, V-7 and V-8, present on the video output 57 at the times t-6, t-7 and t-8 are different from zero. The signal V-7 is less than the value V-max, since the area 52-7 is partially illuminated. The signals V-6 and V-8 are even less, since the areas 52-6 and 52-8 are marginally illuminated.

FIG. 4*b* represents the column 50 of phototransistors at a later time, when it is overlaid to a greater extent on the spot 70. In this second configuration, the spot 70 completely illuminates the light-sensitive areas 52-6, 52-7 and 52-8, and marginally the areas 52-5 and 52-9. In the Cartesian diagram, corresponding to a scanning effected during this second configuration, the signals V-5, V-6, V-7, V-8 and V-9 are different from zero. The signal V-7 is equal to the value V-max, since the area 52-7 is totally illuminated. The signals V-6 and V-8 are slightly less, since the areas 52-6 and 52-8, though completely inside the spot 70, are close to the edges; finally the signals V-5 and V-9 are still less, since the areas 52-5 and 52-9 are illuminated marginally.

Figures 5A, 5B, 5C, 5D, 5E:
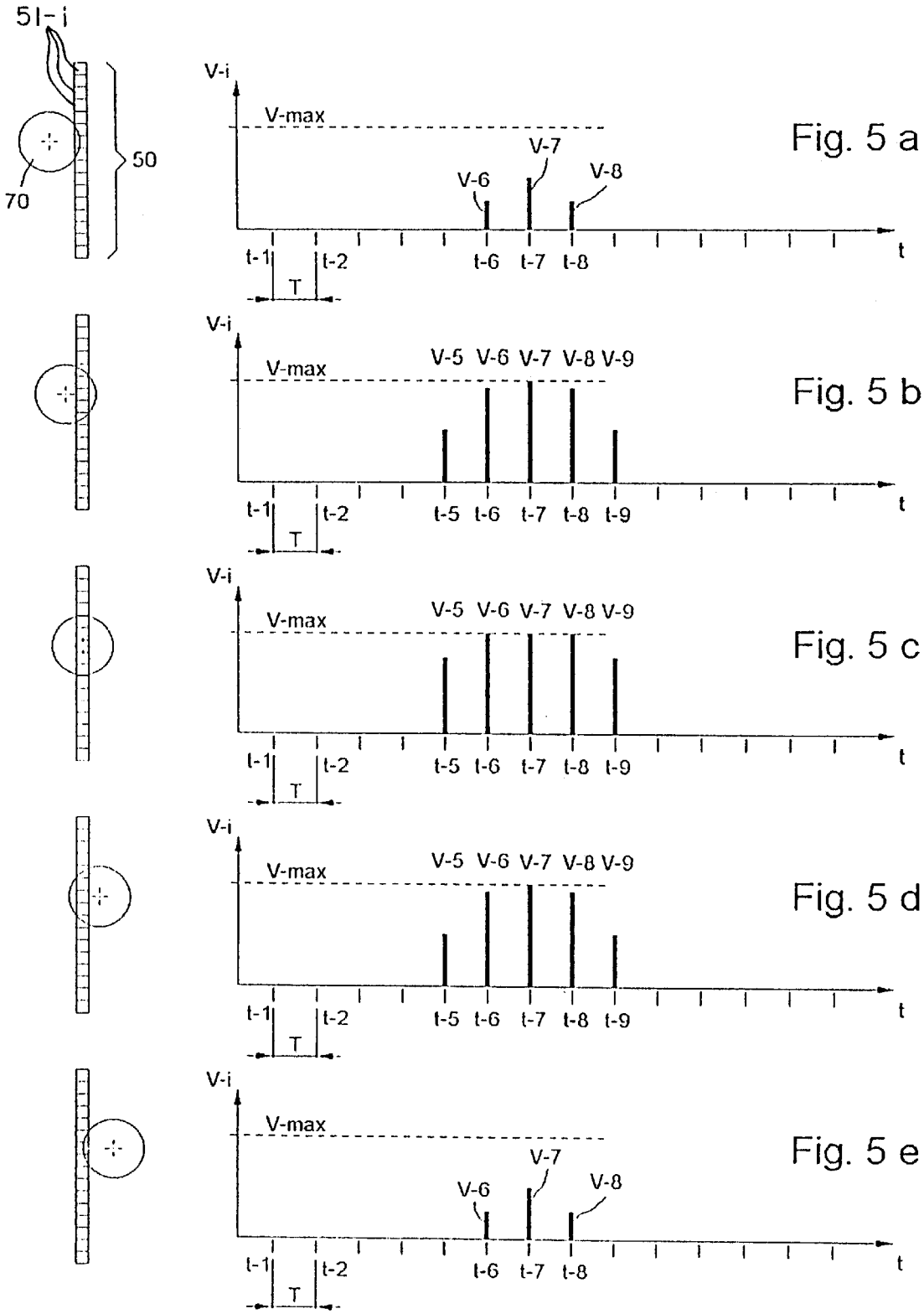
FIGS. 5*a*÷5*e*—Represent various video outputs generated during successive scannings of the phototransistor column.

Depicted by way of example in the FIGS. 5*a*÷5*e* are five of the possible relative positions between the spot 70 and the light-sensitive areas 52-i while the head 40, borne by the carriage 42 at the speed W, passes through the spot 70. In each figure, the signals V-i on the video output 57 are shown, following the scanning effected in each position.

In the condition of FIG. 5*c* the centre of the spot 70 coincides with the vertical line L which represents the centre line of the column 50 of phototransistors, and the sum of the widths of the signals V-i is at its maximum.

It is now possible to describe the alignment system for multiple ink jet colour printheads according to the invention, containing respectively, for example, a black ink a cyan ink, a yellow ink and a magenta ink, and mounted on the scanning carriage 42 of a printer, in turn provided with the illuminating device 43 and the electronic controller described previously. Said alignment system substantially comprises the following steps:

- detection of the vertical misalignment of each head 40,
- staggering of the commands to the nozzles of each head 40, to compensate the vertical misalignment of each single head 40,
- detection of the horizontal misalignment of each head 40,
- correction of the timing of the ejection of the droplets by each single head 40, to compensate the horizontal misalignment.

Detection of the vertical alignment—This is described in relation to a single monochromatic head 40, as it is identical for all the heads.

The signals V-i on the video output 57 are successively processed using known type electronic means, in order to obtain a value for vertical position of the head 40 with respect to the spot 70.

In general, said vertical position is obtained by identifying which of the areas 52-*i* has travelled the horizontal diameter of the spot 70.

In a first processing mode M sums are made, one for each value of i, of the values V-i detected in all the scannings. For i=1 all the values of V-1 detected in the successive scannings are added together and a Total-1 obtained and stored; for i=2 all the values of V-2 detected in the successive scannings are added together and a Total-2 obtained and stored; continuing in the same way, the Totals-i are calculated through to Total-M. A search is made for greatest of all the Totals-I, the index of which, designated as i(m), identifies the area 52-*i* which has received most illumination overall, and has therefore travelled the horizontal diameter of the spot 70.

In a second processing mode the M Totals-i are obtained again by means of the procedure described in the first mode. Subsequently the discrete M Totals-i are used to obtain a continuous mathematical interpolation function, by means of known algorithms, from which the position of the maximum i(max) is calculated. The latter generally assumes a non-integer, intermediate value with respect to the integer values of the index i, and corresponds to an intermediate vertical position with respect to the discrete positions of the light-sensitive areas 52-*i*.

The second processing mode is more precise than the first since, by interpolating the values detected, it eliminates the effect of discontinuity between the light-sensitive areas, and also attenuates the random errors among the various signals V-i.

Correction of the vertical position of each single head—In accordance with a technology well known to those acquainted with the sector art, the ink ejection nozzles are disposed on the head 40 in two vertical columns, that is to say parallel to the y axis, and are maintained apart by a constant pitch which, in the current art, may assume the value of 1/600 of an inch (≈42 μm) or 1/1200 of an inch (≈21 μm).

The correction of the vertical position according to this invention is effected by the electronic controller of the printer for those heads which, as based on detection of the vertical alignment, are vertically misaligned, by staggering the commands to the nozzles by one or more positions upwardly or downwardly.

As the amount of the correction is equivalent to a whole number of pitches, in the alignment between the heads 40 a residual error of within ± half a pitch (±21 μm with pitch of 1/600 inch, ±10.5 μm with pitch of 1/1200 inch) is tolerated. In the first processing mode, a discretization error is added to this error, due to the finite dimension of the sensitive areas 52-*i* and within ±A/2 (for instance, ±10 μm with A=20 μm). The discretization error is not present in the second processing mode.

In addition, each column must possess a greater number of nozzles than those actually used for writing, as some nozzles adjacent to the edges remain unused to permit staggering. For example, in the case of a pitch between nozzles of 1/600 inch (≈42 μm), and continuing to assume that the maximum vertical misalignment between the heads remains within ±150 μm, the worst case would require not to use seven nozzles adjacent to one of the edges.

The exact amount of the staggering to be made is calculated by the electronic controller of the printer on the basis of a table for conversion between the value i(m), or i(max), and the microns of misalignment that they represent, stored, for example, in a ROM and predetermined from the known geometric positions of the column 50 and of the light beam 66.

Detection of the horizontal alignment—The scanning carriage 42, with on board the heads 40, is moved in the direction of the x axis at a speed W. The position of the carriage 42 along the x axis is detected by means of an encoder 44 that supplies the position information in the form of periodic signals (strobes) having a determined pitch. Electronic circuits belonging to the controller of the printer count the strobes and determine the position X, along the x axis, of a gauge block 45 on the carriage 42, using means well known to those acquainted with the sector art.

Furthermore, these same electronic circuits are capable of evaluating movements corresponding to strobe fractions, using equally well known interpolation methods.

The reference is taken to be a point $X_1$ reached by the gauge block 45 on the carriage when the centre line L of the first column 50, belonging to a head 40 designated as "first", passes through the centre of the spot 70.

The theoretical point $X_2$, which should be reached by the gauge block 45 when the centre line L of a second column 50, belonging to a head 40 designated as "second", passes through the centre of the spot 70, is given by the relation $$X_2=X_1+E_2$$

where $E_2$ represents the theoretical distance between the first and the second head.

In like manner, the theoretical point $X_n$, which should be reached by the gauge block 45 when the centre line L of a n-th column 50, belonging to a n-th head 40 passes through the centre of the spot 70, is given by the relation $$X_n=X_1+E_n$$

where $E_n$ represents the theoretical distance between the first and the n-th head.

The remainder of the description is restricted to detection of the misalignment of the second head 40, as the procedure relative to the further heads 40 is identical and can be readily extrapolated by those acquainted with the sector art.

Detection of the horizontal misalignment of the second head 40, with respect to the theoretical position, involves measuring the deviation $\Delta X_2$ between the point $X_{2p}$ actually reached by the gauge block 45 when the centre line L of the column 50 is in correspondence with the centre of the spot 70, and the theoretical point $X_2$ at which this correspondence should occur.

Said deviation equals $$\Delta X_2=X_{2p}-X_2$$

and is of negative sign if the head 40 is displaced horizontally in the same direction as the scanning of the carriage 42 with respect to the theoretical position that it should be in (that is to say, it is early during motion), and of positive sign if the head 40 is displaced horizontally in the direction opposite the scanning of the carriage 42 with respect to the theoretical position that it should be in (that is to say, it is late).

The calculation process suitable for obtaining $X_{2p}$ uses the same values V-i as obtained during the scannings made in detecting the vertical alignment.

In a first processing mode K sums are effected, one for each of the K scannings made during the illumination of the column 50, of all the values V-i detected during each of said scannings. By means of known algorithms, the greatest of the K totals thus obtained is sought, identifying a scanning S(m) during which the column 50 was on average more illuminated.

The point $X_{2p}$ lies within an interval of uncertainty the limits of which are calculated in the way that follows, wherein the starting point of the scanning S(m) is indicated with the symbol $X_{sm}$, while the symbols S, i(m), W and M respectively indicate: the duration of the scanning, the index of the area 52-*i* that has received most illumination, the speed of the carriage 42 and the number of light-sensitive areas 52-*i*:

$$\text{Lower extreme: } X_{2inf}=X_{sm}+W\cdot(S\cdot i(m)/M-S/2)$$

$$\text{Upper extreme: } X_{2sup}=X_{sm}+W\cdot(S\cdot i(m)/M+S/2)$$

The average of said extremes is taken as the value of $X_{2p}$, coinciding with the expression:

$$X_{2p}=X_{sm}+W\cdot(S\cdot i(m)/M)$$

whereas the interval of uncertainty $X_{2p}$ is equal to ±S/2.

In a second processing mode, a plane (x–i) is defined having as the abscissa the x axis already defined, and as the ordinate the integer variable (i). All the V-i values obtained during all the scannings are given as a point above the plane (x–i), each in correspondence with an own index i and the point X at which it was detected.

Subsequently, using known algorithms, a continuous interpolation function V=f (x, i) is obtained, from which, using other known algorithms, the position of the maximum is calculated, the coordinates of which coincide with the point $X_{2p}$ sought and with i(max), generally not an integer, already defined and used for detecting the vertical alignment.

The second processing mode is more precise than the first since, by interpolating the values detected, it eliminates the interval of uncertainty in the value of $X_{2p}$, and also attenuates the random errors among the various signals V-i.

Correction of the horizontal position of each head—The horizontal misalignment of the n-th head 40 is corrected by the electronic controller of the printer by altering the timing of ejection of the droplets of ink, with respect to a theoretical time $t_n$, by an interval $$\Delta t_n=(\Delta X_n)/W_L$$

where $W_L$ is a generic working speed, not necessarily equal to W.

The effective time $t_{np}$ of ejection of the ink is:

$$t_{np}=t_n+(\Delta t_n)$$

In particular, if the n-th head 40 arrives early, $\Delta t_n$ is negative, and correspondingly the ejection of the droplets of ink is in advance, whereas if the n-th head 40 arrives late, $\Delta t_n$ is positive, and correspondingly the ejection of the droplets of ink is deferred.

Second embodiment

Figure 6:
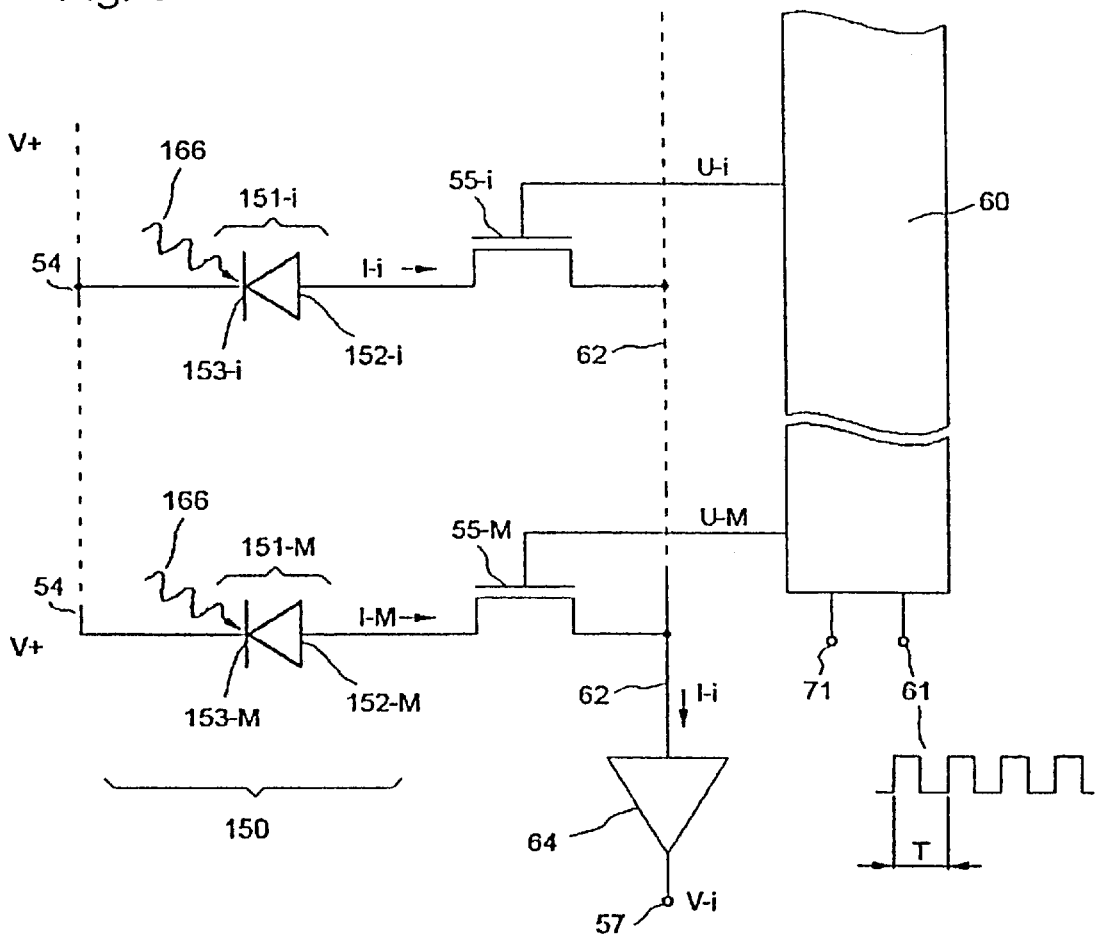
FIG. 6—Represents the schematic circuit diagram of a column of photodiodes constituting an optoelectronic device.

The column 50 of phototransistors may be substituted by a column 150 of photodiodes, the wiring diagram of which is depicted in FIG. 6, though restricted to the two photodiodes i-th and M-th. The column 50 is also built into the same support and made with the same process steps as needed for the manufacture of the semiconductor integrated circuits that carry out the other functions of the head 40.

From the electric viewpoint, the column 50 is made up of M photodiodes 151-*i*, with i varying between 1 and M, having the cathodes 153-*i* electrically connected together at a common node 54 fed with a positive voltage V+, and having independent anodes 152-*i*.

Figure 7:
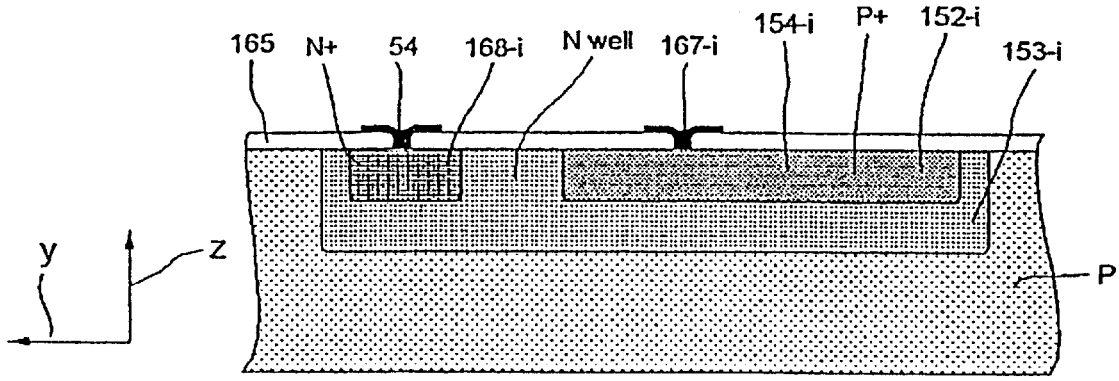
FIG. 7—Represents the physical structure of one photodiode of the column of FIG. 6.

The physical structure of the column 50 of photodiodes is represented schematically in FIG. 7 in a view according to a section parallel to the plane y-z, which depicts only one of the photodiodes 151-*i*, consisting of a N "well" zone made by diffusion on a P type silicon substrate and constituting the cathode 153-i connected to the common node 54 through an N+ type contact 168-*i* and of a P type "zone" constituting the anode 152-*i*. The column 50 of photodiodes is then protected by a protective passivating layer 165, with the exception of the areas on which the metallizations are deposited that constitute the contacts with the output conductors 54 for the cathodes and 167-*i* for the anodes.

The light-sensitive area consists of the junction 154*i* between the anode 152-*i* and the cathode 153-*i*.

The photodiodes 151-*i* are inversely polarized, but permit the passage of the photocurrents I-i, substantially proportional to the area illuminated and to the intensity of the light affecting each of the junctions 154-*i*, when the latter are duly illuminated by a light beam 166.

In the photodiodes the ratio of the current I-i to the light power striking the corresponding junction 154-*i* is normally less than the like ratio in the phototransistors.

The MOSFET transistors 55-*i* the common bus 62, the shift register 60 and the charge amplifier 64 are substantially identical to those already described for the first embodiment. The geometric configurations of the light-sensitive areas 154-*i* and of the column 50 are substantially similar to those of the light-sensitive areas 52-*i* and of the column 50, already described.

Further, the generation of the signals V-i on the output 57, the use of said signals V-i for detecting of the vertical and horizontal alignments, and the corrections of the vertical and horizontal positions of the head 40 are achieved using methods identical to those already described for the first embodiment.

Third embodiment

The optoelectronic position detector can be made using a linear type PSD ("Position Sensitive Detector") photodiode, the operation of which is based on lateral photoelectric effect, known to those acquainted with the sector art.

In accordance with this invention, the PSD is integrated, using the CMOS/LDMOS technology, in the same chip as the head 40, i.e. it is made in the course of the same production process, with the same process steps and the same masks as are needed in any case to produce an integrated thermal ink jet head, and therefore without any increase of the costs and difficulty with respect to the known heads.

Figure 8:
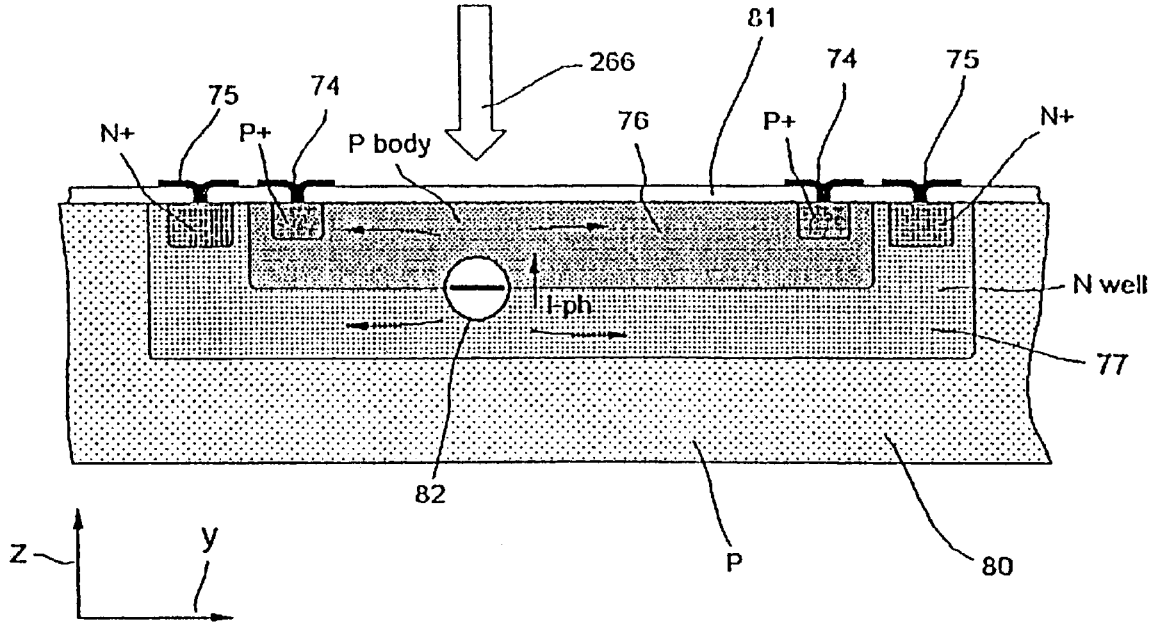
FIG. 8—Represents schematically a sectional view of a linear PSD.

The linear PSD built into the head 40 is made of crystalline silicon and is ilustrated schematically in FIG. 8 in sectional view. The PSD consists of:

- a substrate 80 of P type silicon, having resistivity preferably between 10 and 20 Ω·cm;
- an N type "well" 77, of a thickness preferably between 3 and 8 μm and having a substrate Resistance, hereinbelow referred to as "R-sheet", preferably between 1200 and 1800 Ω/□;
- a P type "body" 76, of a thickness preferably between 1 and 2 μm and having an R-sheet preferably between 800 and 1200 Ω/□;
- two anodes 74, connected to the "body" 76 via two P+ diffusions;
- two cathodes 75, connected to the well 77 via two N+ diffusions.

The body 76 is protected by a protective passivating layer 81, with the exception of the areas on which the metallizations are deposited that constitute the output conductors for the cathodes and for the anodes.

Figure 9:
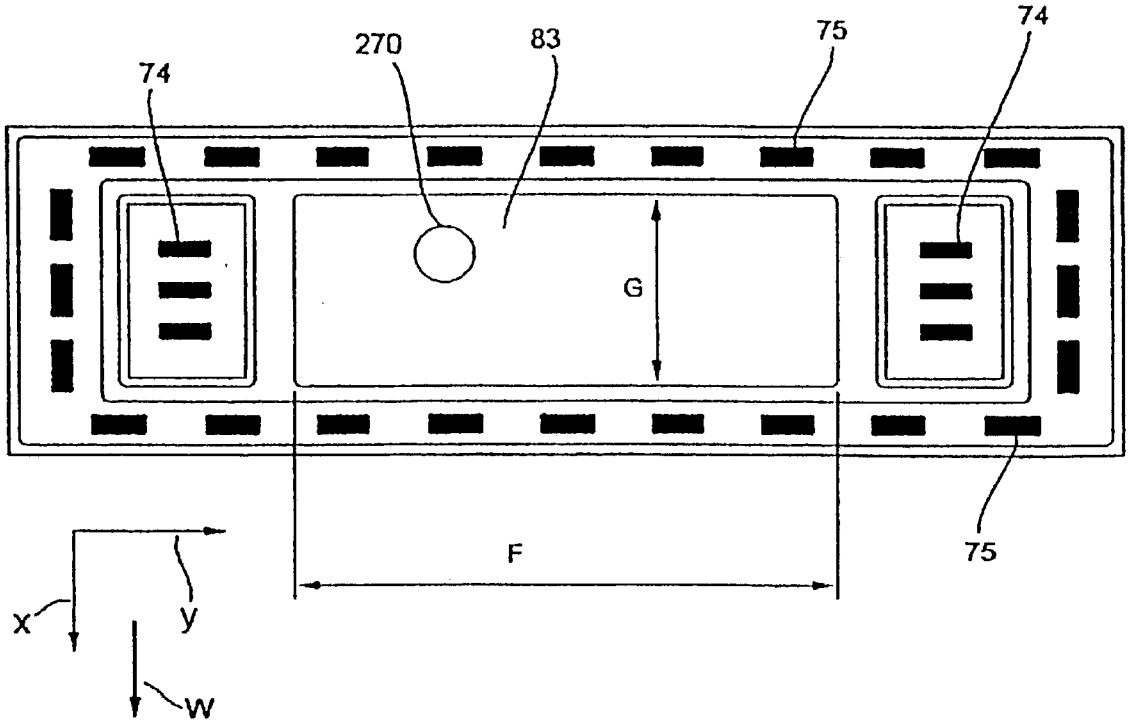
FIG. 9—Represents a plan view of the linear PSD of FIG. 8.

The geometric configuration of the PSD is illustrated in FIG. 9, which also indicates the x axis, parallel to the scanning direction, and the y axis, parallel to the line feed direction and to the rows of nozzles.

The light-sensitive area has, by way of example, the shape of a rectangular window 83, the dimensions F and G of which are preferably within the following limits:

| | | |
|---|---|---|
| F | Height, parallel to the y axis | 300 ÷ 2000 μm |
| G | Width, parallel to the x axis | 50 ÷ 200 μm |

Then the head 40, borne by the carriage 42 moving at a speed W parallel to the x axis, passes through a light beam 266, the latter forms a spot 270 on the window 83.

Figure 10:
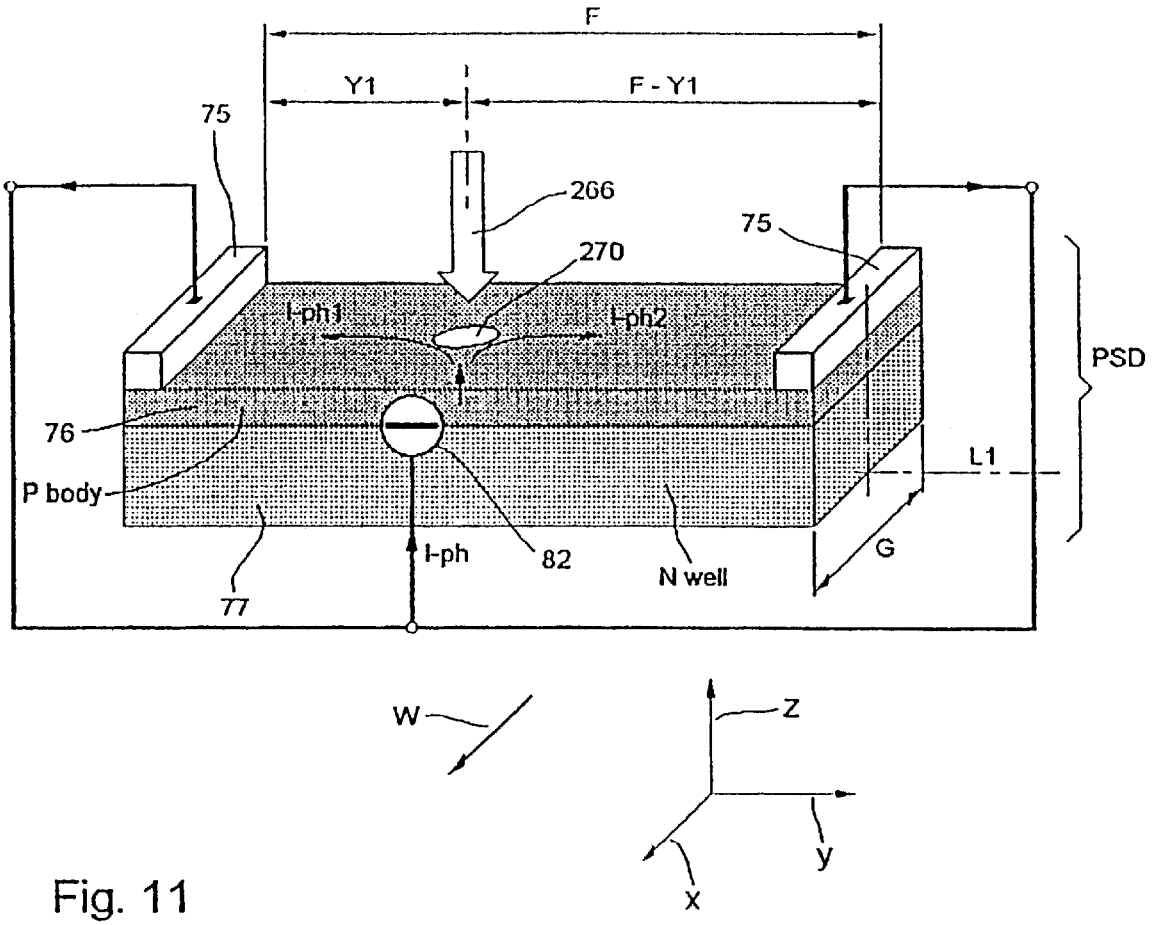
FIG. 10—Represents an axonometric projection of the linear PSD of FIG. 8.
Figure 11:
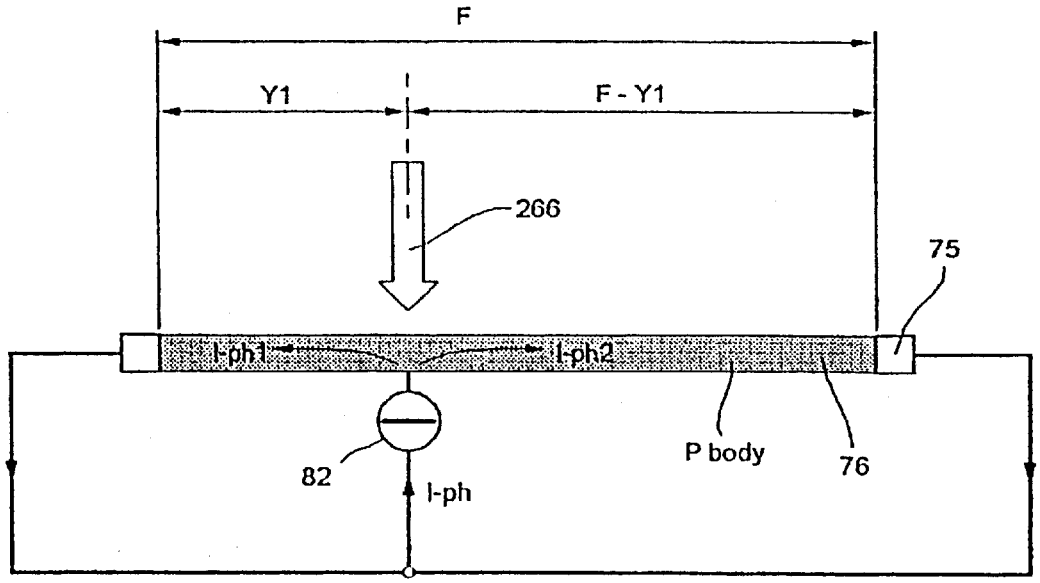
FIG. 11—Represents the schematic circuit diagram of the linear PSD of FIG. 8.

Operation of the linear PSD built into the head 40 is described with reference to the axonometric projection of FIG. 10 and to the diagram of FIG. 11.

The spot 270 generates a current I-ph, represented by means of a current generator 82, in correspondence with the P/N junction between the body 76 and the well 77, inversely polarized.

The current I-ph subdivides into two currents I-ph1 and I-ph2, collected by the two anodes 74, inversely proportional to the distances Y1 and (F−Y1) between the centroid, i.e. the point of greatest luminosity, of the spot 270 and the anodes 74. In fact the PSD, being in reality a photoresistor, acts in practice as an optoelectronic potentiometer.

During measurement of the misalignment, the carriage 42 bearing on board the head 40 with the PSD is moved at low speed W, for example 1 cm/s in the direction indicated by the vector W parallel to the x axis, in such a way that the PSD passes through the spot 270.

When the current I-ph is close to its maximum value, the two currents I-ph1 and I-ph2 are measured with integrated electronic measuring devices, known in themselves.

Detection of the vertical alignment is effected by obtaining the vertical distance Y1 of the centre of the spot 270 from one of the sides of length G of the window 83, by means of the expression $$Y1=F\cdot I\text{-}ph2/(\text{I-ph}1+\text{I-ph}2)$$

Detection of the horizontal alignment of the n-th head with respect to the first taken as the reference, is effected by measuring the deviation $$(\Delta X_n)=X_n-X_{np}$$

between the point $X_{np}$, wherein the centre line L1 of the PSD, on board the head borne by the scanning carriage, is in correspondence with the centre of the spot 270, and the theoretical point $$X_n=X_1+E_n$$

at which this correspondence should occur.

The point $X_{np}$ is detected in correspondence with the point in time at which the current I-ph reaches its maximum value, if the diameter of the spot 270 is greater than G, or in correspondence with the point in time at which the current I-ph exceeds a predetermined threshold value, if the diameter of the spot 270 is less than G.

The currents of the PSD may present a drift due to "offset" phenomena, leakage currents, low frequency noise, ambient light, etc. To overcome these drawbacks, the light beam 266 can be chopped at the frequency of a few kHz, or the output currents of the PSD can be modulated by means of a DC/AC converter, according to known techniques.

The PSD has the advantage of not requiring an incident beam with accurate focalisation and uniform distribution. In addition, the linearity of the PSD is barely sensitive to the diameter of the spot 270, provided this diameter is considerably less than the long side F of the window 83. Experience in using the PSD shows that the position detection accuracy of the spot along the y axis is greater than 0.5% of F. However, in order to achieve this accuracy, good R-sheet uniformity of the diffusion P is required, easily achieved using the technology called ion implantation, known to those acquainted with the sector art.

The corrections of the vertical and horizontal positions of the head are made with the same methods as those already described for the first embodiment.

In short, while fully maintaining the principle of this invention, the construction details and the embodiments may be abundantly varied with respect to what has been described and illustrated, without departing from the scope of the invention.

We claim:

1. Aligning method for a multiple ink jet printhead (40) in a dot matrix printer, said printer comprising:

a fixed structure (41);

a carriage (42) suitable for supporting a multiplicity of ink jet printheads (42) and for moving according to a first direction (x), said printheads (40) being each provided with a plurality of nozzles arranged at a constant pitch in at least one column parallel to a second direction (y), substantially perpendicular to said first direction (x), at least two printheads of said printheads (40) being each provided with integrated optoelectronic means consisting of a plurality (50) of integrated phototransistors **(51-*i*) arranged along a column (50) parallel to said second direction, each integrated phototransistor (51-*i*) having an open base (52-*i*), an independent emitter (56-*i*), and a collector (53-*i*) connected to a common node (54)**;

an electronic controller suitable for controlling the timing of the ejection of droplets of ink by the nozzles of said printheads (40); and an illuminating device (43) integral with said fixed structure (41) and provided for generating a light beam (66, 70);

wherein said method comprises the following steps:

moving said carriage (42) according to said first direction (x);

illuminating by means of said light beam (66, 70) said integrated phototransistors **(51-*i*), during the movement of said carriage (42), so as to generate a plurality of electric signals corresponding to said integrated phototransistors (51-*i*)**;

scanning in succession and in a cyclical order said integrated phototransistors **(51-*i*)** or detecting said electric signals;

calculating a first misalignment of said at least two printheads (40) according to said first direction (x) and a second misalignment of said at least two printheads (40) according to said second direction (y), by processing said electric signals;

compensating said first misalignment of said at least two printheads (40) according to said first direction, by altering the timing of the ejection of said droplets of ink; and compensating said second misalignment of said at least two printheads (40) according to said second direction by staggering the commands sent by said electronic controller to said two printheads (40) for the ejection of said droplets of ink.

2. Aligning method according to claim 1, wherein said plurality (50) of integrated phototransistors **(51-*i*) is replaced by a corresponding plurality (150) of integrated photodiodes (151-*i*) arranged along a column (150) parallel to said second direction, each photodiode (151-*i*) having an independent anode (152-*i*) and a cathode (153-*i*) connected to a common node (54)**.

3. Aligning method according to claim 1 or 2, further comprising the step of switching in sequence a plurality (K) of times depending on the number of scanning cycles of said electric signals, the currents (I-i) which are activated in correspondence with said independent emitters **(56-*i*), or in correspondence with said independent anodes (152-*i*), in order to generate a unique signal (V-i) on an output (57)**.

4. Aligning method according to claim 3, wherein each integrated phototransistor **(51-*i*) or each integrated photodiode (151-*i*) of said optoelectronic means are defined by an index (i) along the respective column (50; 150)**, further comprising the step of determining, for each of the values of said index (i), the sum of the values (V-i) of the electric signals detected during the successive scannings (K) of said integrated optoelectronic means, so as to obtain a plurality of total values (Total-i).

5. Aligning method according to claim 4, further comprising the step of searching for the greater of said total values (Total-i).

6. Aligning method according to claim 4, further comprising the step of obtaining a mathematical interpolating function of said total values (Totals-i) in function of said index (i), and of calculating the maximum position of said function.

7. Aligning method according to claim 4, further comprising the step of obtaining a mathematical interpolating function of said total values (Totals-i) in function of said index (i) and of the position (x) of the corresponding phototransistor **(51-*i*) or photodiode (151-*i*)** along said first direction, and of calculating the maximum position (i(max)), ($X_{np}$) of said function.

8. Aligning method for a multiple ink jet printhead (40) in a dot matrix printer, said printer comprising:

a fixed structure (41);

a carriage (42) suitable for supporting a multiplicity of ink jet printheads (40) and for moving with respect to said fixed structure according to a first direction (x), said printheads (40) being provided with a plurality of nozzles arranged at a constant pitch in at least one column parallel to a second direction (y), substantially perpendicular to said first direction (x), at least two printheads (40) of said printheads being each provided with integrated optoelectronic means consisting of a linear position detector (PSD), said position detector (PSD) comprising a rectangular shaped light-sensitive window (83) with a first side parallel to said first direction (x) and with a second side parallel to said second direction (y);

an illuminating device integral with said fixed structure and provided for generating a light beam (266, 270); and an electronic controller suitable for controlling the timing of the ejection of droplets of ink by said printheads (40);

wherein said method comprises the following steps:

moving said carriage (42) according to said first direction (x);

illuminating by means of said light beam (266) said linear position detector (PSD), during the movement of said carriage (42), so as to activate a first current (I-ph1) and a second current (i-ph2) generated by said light-sensitive window (83);

calculating a first misalignment of said printheads (40) according to said first direction and a second misalignment of said printheads according to said second direction, by processing the values of said first and of said second current;

compensating said first misalignment of said heads (40) according to said first direction (x), by altering the timing said ejection of droplets of ink; and compensating said second misalignment of said heads (40) according to said second direction (y) by staggering the commands sent to said nozzles for the ejection of said droplets of ink.

9. Aligning method according to claim 8, wherein the step of calculating the misalignment of said printheads (40) according to said first direction (x), comprises the following phase:

determining, on the base of the values of said first and of said second current, the distance (Y1) of said light beam (270) from the first side, parallel to said first direction (x), of said light-sensitive window (83), and wherein the step of calculating the misalignment of said printheads (40) according to said second direction (y), comprises the following phase: obtaining a point ($X_{np}$) in correspondence with the maximum of the sum (I-ph1+I-ph2) of said first and of said second current, in function of the displacement along said first direction (x) of said linear position detector (PSD); or obtaining a point ($X_{np}$) in correspondence with the surpassing of a predetermined threshold by said sum (I-ph1+I-ph2).

10. Aligning method according to claim 1, wherein the printheads (40) of said multiple ink jet printhead are four in number and contain respectively a black ink, a cyan ink, a yellow ink and a magenta ink.

11. Ink jet dot-matrix printhead (40) suitable for moving during printing according to a first direction (x), comprising:

a semiconductor substrate;

a first plurality of ejection elements, integrated on said substrate, for the generation of droplets of ink through a corresponding plurality of nozzles, said ejection elements being arranged at a constant pitch in at least one column according to a second direction (y), substantially perpendicular to said first direction (x);

a second plurality of electronic components integrated on said substrate by means of C-MOS technology for selecting and driving said first plurality of ejection elements; and a plurality of phototransistors (51-*i*) arranged along a column (50) parallel to said second direction (y) and integrated on said substrate by means of said C-MOS technology, said integrated phototransistors (51-*i*) having each an open base (52-*i*) and an independent emitter (56-*i*), and moreover having respective collectors (53-*i*) connected to a common node (54), said plurality of phototransistors (51-*i*) being provided for being illuminated by an external light source during the movement of said printhead (40) so as to generate corresponding electric signals suitable for being scanned cyclically and processed in order to determine and compensate a misalignment of said printhead (40) with respect to another similar printhead (40).

12. Printhead (40) according to claim 11, wherein the open base (52-*i*) of each phototransistor (51-*i*) has a rectangular shaped photo-sensitive surface with a first side parallel to said first direction and with a second side parallel to said second direction.

13. Printhead according to claim 12, wherein said first side has a dimension (B) of between 10 and 200 $\mu$m and that said second side has a dimension (A) of between 10 and 50 $\mu$m.

14. Printhead according to claim 11, wherein said plurality of phototransistors is replaced by a plurality the column (50) is substituted by a column (150) made up of a plurality of integrated photodiodes (151-*i*) having cathodes (153-*i*) connected to a common node (54), and each having an independent anode (152-*i*).

15. Printhead according to claim 11, wherein said integrated phototransistors (51-*i*) or said integrated photodiodes (151-*i*) are made, during manufacturing of the printhead, by means of the same masks as used to produce the integrated circuits on board of the printhead itself.

16. Ink jet dot-matrix printhead (40) suitable for moving during printing according to a first direction (x), comprising:

a semiconductor substrate;

a first plurality of ejection elements, integrated on said substrate, for the generation of droplets of ink through a corresponding plurality of nozzles, said ejection elements being arranged at a constant pitch in at least one column according to a second direction (y), substantially perpendicular to said first direction (x);

a second plurality of electronic components integrated on said substrate by means of C-MOS technology for selecting and driving said first plurality of ejection elements; and a linear position detector (PSD) integrated on said substrate by means of said C-MOS technology, said linear position detector (PSD) being provided for being illuminated by an external light source during the movement of said printhead (40) in order to generate a first current (I-ph1) and a second current (I-ph2) suitable for being detected in order to determine and, if necessary, to compensate a misalignment of said printhead (40) with respect to another similar printhead (40).

17. Printhead according to claim 16, wherein said position detector (PSD) comprises a rectangular shaped light-sensitive window (83) with a first side parallel to said first direction and with a second side parallel to said second direction, and wherein said first side has a dimension (G) of between 50 and 200 $\mu$m, and said second side has a dimension (F) of between 300 and 2000 $\mu$m.

18. Printhead according to claim 16, wherein said position detector (PSD) is made, during manufacturing of the printhead, by means of the same masks as used to produce the integrated circuits on board of the printhead itself.

19. Ink jet dot-matrix printer comprising a fixed structure (41);

a carriage (42) suitable for supporting a multiplicity of ink jet printheads (42) and for moving according to a first direction (x), said printheads (40) being each provided with a plurality of nozzles arranged at a constant pitch in at least one column parallel to a second direction (y), substantially perpendicular to said first direction (x), at least two printheads of said printheads (40) being each provided with integrated optoelectronic means, said optoelectronic means consisting of a plurality of integrated phototransistors (51-*i*) arranged along a column (50) parallel to said second direction, each of said integrated phototransistors (51-*i*) having an open base (52-*i*), an independent emitter (56-*i*), and a collector (53-*i*) connected to a common node (54), or said optoelectronic means consisting of a plurality of integrated photodiodes (151-*i*) arranged along a column (150) parallel to said second direction, each of said photodiodes (151-*i*) having an independent anode (152-*i*) and a cathode (153-*i*) connected to a common node (54);

an electronic controller suitable for controlling the timing of the ejection of droplets of ink by the nozzles of said printheads (40);

an illuminating device (43) integral with said fixed structure (41) and provided for illuminating by means of a light beam (66, 70) said integrated phototransistors (51-*i*) or said integrated photodiodes (151-*i*), when said prinheads (40) as moved by said carriage pass through said light beam, so as to activate a plurality of electric signals generated by and corresponding to said integrated phototransistors (51-*i*) or to said integrated photodiodes (151-*i*);

computing means, associated with said electronic controller, suitable for processing said electric signals to calculate a first misalignment of said printheads (40) according to said first direction and a second misalignment of said printheads (40) according to said second direction;

means suitable for compensating said first misalignment of said printheads (40) according to said first direction, by altering the timing of the ejection of said droplets of ink; and means suitable for compensating said second misalignment of said printheads (40) according to said second direction by staggering the commands sent by said electronic controller to said printhead for activating the ejection of droplets through said nozzles.

20. Printer according to claim 19, wherein said printheads (40) are four in number and contain respectively a black ink, a cyan ink, a yellow ink and a magenta ink.

* * * * *